United States Patent [19]

Fratty

[11] 4,272,801

[45] Jun. 9, 1981

[54] MOTOR VEHICLE HEAD LAMP LENSES HAVING LIGHT DEFLECTING RIBS

[75] Inventor: Hector Fratty, Boulogne, France

[73] Assignee: Cibie Projecteurs, Bobigny, France

[21] Appl. No.: 44,821

[22] Filed: Jun. 1, 1979

[30] Foreign Application Priority Data

Jun. 9, 1978 [FR] France ..... 78 17312

[51] Int. Cl.[3] ..... F21V 5/00

[52] U.S. Cl. ..... 362/336; 362/61; 362/300; 362/338

[58] Field of Search ..... 362/61, 64, 65, 215, 362/267, 268, 290, 291, 292, 309, 336, 338, 300; 65/37, 305; 204/281, 3, 6, 129.1

[56] References Cited

U.S. PATENT DOCUMENTS

| | | | |
|---|---|---|---|
| 1,862,078 | 6/1932 | Falge | 362/336 |
| 2,272,119 | 2/1942 | Saechel | 65/37 |
| 3,330,951 | 7/1967 | Neal | 362/309 |
| 4,100,388 | 7/1978 | Meyer | 204/129.1 |

*Primary Examiner*—Donald P. Walsh

*Attorney, Agent, or Firm*—Alan H. Levine

[57] ABSTRACT

This invention relates to a motor vehicle headlamp lens.

It is characterized in that at least one zone of ribs is formed by ribs of variable cross-section, so that the optical deflection effect varies from one point of the rib to another.

Improvement of the characteristics of the beam passing therethrough.

3 Claims, 10 Drawing Figures

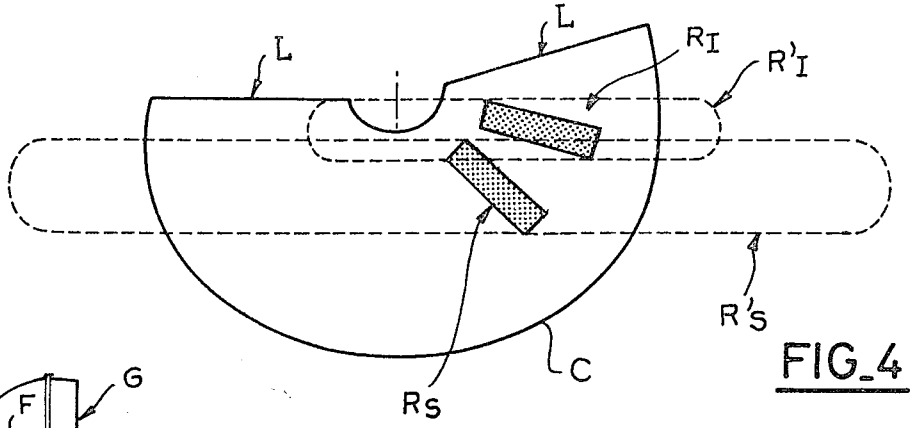
FIG_4
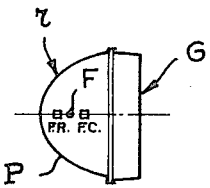
FIG_2
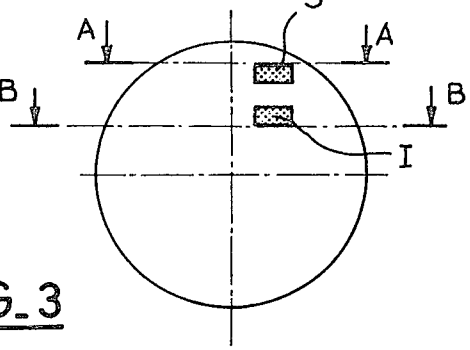
FIG_3
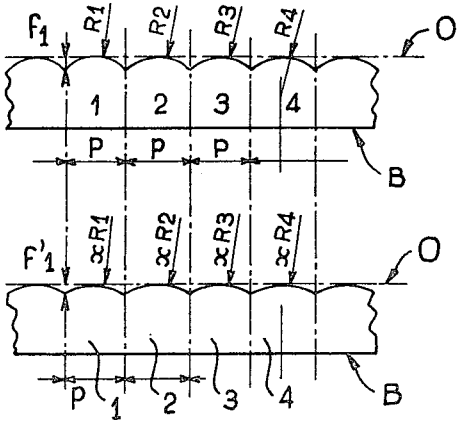
FIG_5a
FIG_5b
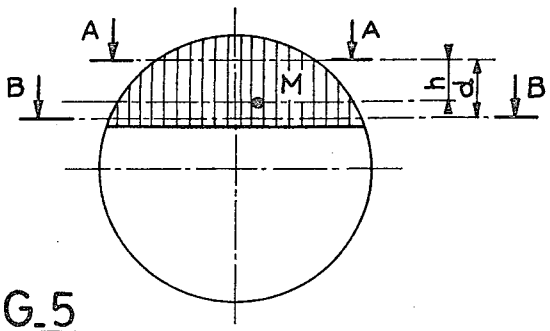
FIG_5

MOTOR VEHICLE HEAD LAMP LENSES HAVING LIGHT DEFLECTING RIBS

This invention relates to motor vehicle headlamps of the type comprising a reflecting mirror having at least one parabolic reflecting surface, at least one light source co-operating with the mirror to produce a beam of light, and a substantially vertical front lens closing the mirror opening.

Optically the function of a lens of this kind is to deflect the rays of light reflected by the reflector in order to adapt the beam to the requirements in respect of illumination of a road or motorway depending upon the types of illumination required (i.e. a main-beam or a dipped-beam illumination). To act as deflecting elements, the lenses are usually provided with prismatic elements (each acting as a deflecting prism) or ribs (each acting as a divergent or convergent lens).

This invention relates specifically to headlamps with lenses provided with ribs and, more particularly, vertical ribs used to deflect laterally to the left or right the beams of light passing through the lens.

In order that the invention may be satisfactorily defined, the geometric configuration of the ribs conventionally used in motor vehicles should be specified.

In the case of a generally flat lens, the rib is formed in relief (raised or sunken) in cylindrical shape, the generatrices of this cylindrical surface extending in parallel relationship to the general plane of the lens; the cross-section of a rib of this kind (the director curve of the cylindrical surface) is formed by a circle whose radius remains invariable from one end of the rib to the other.

In the case of a curved lens, the cylindrical rib defined above is curved to follow the curvature of the lens, but its cross-section remains a circle of constant radius. Its generatrices are no longer parallel straight lines, but curves following the actual curvature of the lens. Hereinafter, in order to simplify the explanation, ribs of this kind on a curved lens will be referred to as "pseudo-cylindrical".

The cylindrical ribs have numerous functions in motor vehicle headlamps.

For example, such ribs may be disposed vertically on a headlamp lens to control the extent (lateral dispersion) of the beam of light passing through the lens or, more generally, its orientation and its spread.

A plurality of zones of ribs may also be provided on a headlamp lens, each zone acting as a different deflector. In such an application, moulding faults appear irreparably at the connection between the different zones because of the break between the zones.

In all their applications it is known that the deflecting function of a rib depends on its radius and on its height in relation to the base surface of the lens bearing it. For a given set of ribs, the effect obtained depends also on their relative spacing.

With the cylindrical or pseudo-cylindrical ribs of constant radius section known heretofore, it is impossible to vary the optical deflection properties from one point of a rib to another, or from one point of a zone of identical parallel ribs to another. It is generally not possible to vary the properties of one rib or one zone of ribs without a break and, as indicated hereinbefore, the break between two zones of adjacent ribs results in moulding faults and optical imperfections. Applicants have already proposed at least a partial solution to these problems, and this is described in their French patent application No. 7908440 filed on Mar. 9, 1979 for "Improvements to headlamp lenses and their manufacture" which is cited for reference. This solution, while retaining the cylindrical or pseudo-cylindrical shape of the ribs—i.e. a rib section of constant radius—resides in a progressive variation of the height and the relative spacing of the different ribs.

This invention proposes another solution of more general application and very easy embodiment.

According to the invention, the ribs are given a variable profile so that the circular or substantially circular rib cross-sectional arc varies in its radius of curvature all along the rib.

The result of this arrangement is that the divergence or convergence properties of the rib vary according to the region involved. Of course, a convergent rib will be made in raised form with respect to the general plane of the lens while a divergent rib will be made in sunken form.

Preferably, the rib pitch according to the invention (understood as being the chord subtending the cross-sectional arc) is constant from one end of the rib to the other.

In terms of optics, the use of ribs with a variable cross-sectional arc in every case enables the optical effect of the rib to be modulated in each specific case according to the lens region involved. It also enables connecting zones to be provided between zones of cylindrical or pseudo-cylindrical ribs of the same pitch, said connecting zones being formed by segments of variable-profile ribs of the same pitch connecting a cylindrical segment of a certain cross-sectional radius to another segment of different radius.

For practical performance of the invention, the only problem, if it is desired to apply the conventional moulding technique using a reference surface and a punch bearing the impression of the ribs, lies in the production of the punch. This can be done by machining or by spark-erosion.

Finally it should be understood that just as pseudo-cylindrical ribs have been defined hereinbefore (on curved lenses) by extension from cylindrical ribs (on flat lenses), the invention includes curved lens ribs whose curved generatrices follow the curvature of a curved lens while their cross-section varies from one point of the rib to another.

The following description with reference to the accompanying drawing will show how the invention can be performed and also its great advantage in the production of motor vehicle headlamp lenses.

The prior art will be described first of all.

In the accompanying drawings:

FIG. 1 is the front view of a motor vehicle headlamp lens provided with a system of vertical ribs extending to the top part of the lens.

FIG. 1*a* is a section on the plane AA in FIG. 1.

FIG. 1*b* is a section on the plane BB in FIG. 1.

FIG. 2 is a central vertical section of a headlamp provided with the lens shown in FIG. 1 and in which said lens is vertical.

FIGS. 1, 1*a* and 1*b* illustrate the presence of a zone of ribs 1, 2, 3, 4, . . . on a headlamp lens G. The zone extends beyond the two horizontal planes AA and BB; these ribs are vertical and of conventionally cylindrical shape; this means that the rib 1 has a cross-section of radius $R_1$ over its entire extent, more particularly between the plane AA and the plane BB; similarly, the rib 2 retains the radius $R_2$, the rib 3 the radius $R_3$, and so on.

In other words, the FIGS. 1*a* and 1*b* are identical (and any horizontal section of the ribs would also be identical).

As illustrated, the ribs 1, 2, 3, . . . are lateral diffusion ribs conventionally used on a headlamp P with a parabolic reflector r of focus F and having a main-beam filament Fr behind the focus and a dipped-beam filament Fc in front of the focus.

With the lens G vertical—i.e. perpendicular to the axis of the reflecting mirror—as shown in FIG. 2, the conventional cylindrical ribs serve to spread the dipped-beam laterally. The ribs being cylindrical (constant radius), the lateral spread effect is invariable from one end of the ribs to the other. There is generally no vertical raising or lowering of the beam.

The use of variable-profile ribs according to the invention will now be described in the same application. For this purpose reference will be made to the following Figures where:

FIG. 3 defines two zones or "windows" I and S on a headlamp lens.

FIG. 4 shows the dipped-beam of a headlamp projected on a screen and illustrates the results obtained with variable-profile ribs according to the invention.

FIG. 5 is a front view of a headlamp lens provided with a zone of vertical variable-profile ribs according to the invention.

FIGS. 5*a* and 5*b* are two sections of the rib zone in FIG. 5 on the planes AA and BB respectively.

Figure 6:
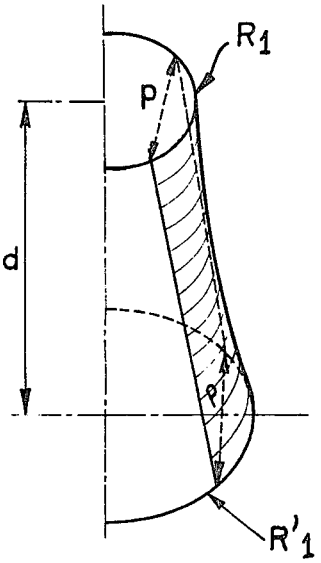
Figure 1:
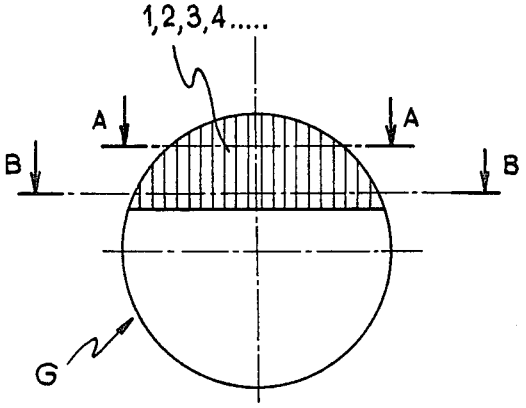
Figure 1A:
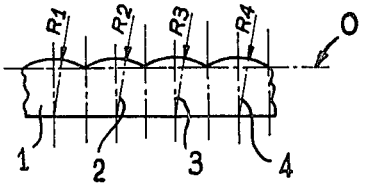
Figure 1B:
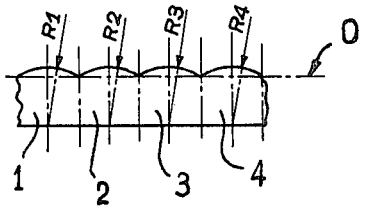

FIG. 6 is a perspective view showing the production of a tool for moulding a raised frusto-conical rib according to the invention.

FIG. 4 shows the image C formed on a screen at a distance of 25 meters by the rays of light from the dipped-beam coming from Fc and reflected by the reflector r of a headlamp as shown in FIG. 2, in the absence of the lens G (or—what amounts to the same—with a plain non-ribbed lens G); cut-off means (e.g. a shield disposed near the filament Fc in manner known per se) cut the beam off along the top cut-off limit L. In the absence of any rib on the lens G, the rays from r passing through the lower window I and the upper window S of the lens G produce images $R_I$ and $R_S$ on the screen.

According to the invention, variable-curvature profile ribs are disposed on the lens G and extend vertically so that they spread the image $R_S$ considerably as far as $R'_S$, while they spread the image $R_I$ only slightly as far as $R'_I$ (FIG. 4).

For this purpose, the ribs according to the invention must (a) have a small cross-sectional radius in the zone S of the lens; (b) a large cross-sectional radius in the zone I; and (c) have a continuous profile from zone I to zone S. In addition, the radius of the rib is varied to a law which enables the light to be lowered vertically in a well-defined manner.

FIGS. 5, 5*a* and 5*b* illustrate arrangements of this kind in a preferred exemplified embodiment. Vertical variable-profile ribs according to the invention are disposed on the lens G and extend between the horizontal plane AA (above the zone S) and the horizontal plane BB (below the zone I).

As was previously the case, the ribs 1, 2, 3, 4, etc. are defined by vertical planes perpendicular to the lens. The pitch p of the ribs (distance between the said vertical planes) is constant from one end to another of all the ribs.

In this example, the ribs all have a uniform total thickness at the centre, of value e (e being the distance between the base surface B of the lens and the line O passing through the apex of the ribs).

Characteristically, according to the invention, the rib radius for rib No. 1 is $R_1$ in the plane AA and increases regularly to $R'_1 = x \cdot R_1$ in the plane BB ($x > 1$).

Similarly, in the case of rib No. 2, the rib radius passes from $R_2$ to $R'_2 = x \cdot R_2$ from the plane AA to the plane BB.

Similarly, rib No. 3 passes from $R_3$ to $R'_3 = x \cdot R_3$, etc.

Generally, rib n (i.e. the rib of order n) passes from a radius $R_n$ to a radius $R'_n = x \cdot R_n$ in the plane BB.

It will be seen that, as was stated, the end rib thickness (i.e. in the vertical planes separating the ribs) is greater at the bottom of the ribs (FIG. 5*b*) than at the top thereof (FIG. 5*a*).

Rib No. n is assumed to have a radius $R_n$ in the plane AA and a larger radius $x \cdot R_n$ in the plane BB ($x < 1$).

At a point M situated at a distance h from the plane AA the radius of rib N . n will be $$R_n + \frac{F(h)}{d}(x \cdot R_n - R_n)$$

where d is the vertical distance between the planes AA and BB; F(h) is a function representing the profile variation of the rib. F(h)=O for a cylindrical rib of radius $R_n$; F(h)=h for a rib whose radius varies linearly along the distance h, from the value $R_n$ in the plane AA to the value $x \cdot R_n$ in the plane BB.

To simplify the explanation, rib No. 1, which has a radius $R_1$ in the plane AA and a radius $R'_1$ in the plane BB will now be taken as an example.

In the plane AA, the rib rise (i.e. the distance from the bottom of the rib to the plane O passing through the apex of the ribs—see FIG. 5*a*) is $f_1$, and in plane BB it is $f'_1$. The following equations apply:

$$f_1 = R_1 \left[1 - \sqrt{1 - \frac{p^2}{4R_1^2}}\right]$$

and $$f_1' = R_1' \left[1 - \sqrt{1 - \frac{p^2}{4R_1'^2}}\right].$$

For a point M between AA and BB, of distance h to AA, the rise f is:

$$f = R \left[1 - \sqrt{1 - \frac{p^2}{4R^2}}\right]$$

where $$R = R_1 + \frac{F(h)}{d}(x R_1 - R_1).$$

The variation in the rise between AA and BB results in the light being lowered vertically by an angle $\alpha$ such that $$\alpha(\text{radians}) = \partial f / \partial h$$

It will be seen that the value of the lowering $\alpha$ depends on $R_1$, $R'_1$, p, d and F(h). In practice, the parameters are selected to give both the required variable lateral deflection and the mean lowering selected.

Numerical example: Ribs of pitch p, with a linear radius variation, where F(h)=h.

Deflection required at rib top=0.6 radian.

Deflection required at rib bottom=0.1 radian.

Hence $p/R_1)=1.56p/R'_1)=0.42$

If p=5 mm $$f_1=1.2 \text{ mm and } R_1=3.2 \text{ mm}$$

$$f'_1=0.24 \text{ mm and } R'_1=12 \text{ mm}$$

i.e. a rise and thickness variation f≃1 mm.

If a mean lowering of 1°30′ (i.e. 0.025 radian) is required over the full width, then $$0.025=1/2d, \text{ i.e. } d=20 \text{ mm}$$

Given a height of d of 40 mm there are two possible solutions:

Either to define two identical bands of 20 mm each, or take a pitch of roughly twice the size, i.e. 10 mm.

In this way it is possible without difficulty to provide one rib after another to give a set of ribs occupying the entire ribbed zone of the lens for optimum illumination.

The problem of the practical production of a variable-profile rib is solved as follows: A rib referred to hereinbefore as rib No. 1 is produced.

The conventional technique is used for making lenses by pressing molten glass between a smooth surface and a punch on which the rib impressions are engraved. The problem is to produce the punch. For a rib of the type shown as rib No. 1 (raised rib), a surface of revolution of height d, the radius of which varies from $R_1$ at the apex to $R'_1$ at the base in accordance with the required variation law, is machined from graphite (FIG. 6). An element is cut out along a plane intersecting the different generating circles along a chord p. This gives a spark-erosion electrode enabling the required rib impression to be produced in sunken form in a block of metal. A metal block of this kind will itself act as the punch.

To make sunken ribs, the machining operation described in FIG. 6 will serve directly to produce the punch impression.

Of course the preferred embodiment in FIGS. 5, 5*a*, 5*b*, in which the ribs according to the invention spread the inclined images (e.g. $R_S$) more widely, is only one example of a very large number of applications of the variable-profile ribs according to the invention in motor vehicle headlamp lenses, more particularly for controlling the width-wise spread and the mean vertical lowering of the beams of light. The ribs according to the invention are adapted advantageously to replace the cylindrical or pseudo-cylindrical ribs in most of their applications.

I claim:

1. A lens for a motor vehicle headlight having a series of substantially vertical ribs, each rib having a cross-sectional shape, in any selected horizontal plane, in the form of a circular arc, the radius of curvature of the circular arc varying continuously along the length of each rib, and the width of each rib being substantially constant along its length, whereby the lateral spread of rays of light passing through the lens varies continuously from one end of each rib to the other and the series of ribs together produces a vertical displacement of the light passing through the lens.

2. A lens as defined in claim 1 wherein the radius of curvature of the circular arc cross-sectional shape of each rib varies linearly along the length of the rib.

3. A lens as defined in claim 1 wherein the series of ribs is formed within the top half of the lens, and the radius of curvature of the cross-sectional shape of each rib decreases from the bottom toward the top of the rib, to give optimum spread to dipped beam light rays passing through the lens.

* * * * *